US007623108B2

(12) United States Patent
Jo et al.

(10) Patent No.: US 7,623,108 B2
(45) Date of Patent: Nov. 24, 2009

(54) ELECTRO-OPTICAL DEVICE, DRIVING CIRCUIT AND DRIVING METHOD THEREOF, AND ELECTRONIC APPARATUS

(75) Inventors: Hiroaki Jo, Suwa (JP); Toshiyuki Kasai, Okaya (JP); Hiroshi Horiuchi, Matsumoto (JP); Takeshi Nozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 762 days.

(21) Appl. No.: 10/999,921

(22) Filed: Dec. 1, 2004

(65) Prior Publication Data

US 2005/0195178 A1 Sep. 8, 2005

(30) Foreign Application Priority Data

Mar. 4, 2004 (JP) ..... 2004-060636

(51) Int. Cl.
*G09G 3/36* (2006.01)

(52) U.S. Cl. ..... 345/98; 345/77; 345/690

(58) Field of Classification Search ..... 345/93, 345/98–100, 87–89, 204, 690, 76–77, 82–83; 315/169.1, 169.3
See application file for complete search history.

(56) References Cited

U.S. PATENT DOCUMENTS

| | | | | |
|---|---|---|---|---|
| 6,229,508 | B1 * | 5/2001 | Kane | 345/82 |
| 2002/0101395 | A1 * | 8/2002 | Inukai | 345/83 |

FOREIGN PATENT DOCUMENTS

| | | |
|---|---|---|
| JP | A 11-202827 | 7/1999 |
| JP | A 2000-122598 | 4/2000 |
| JP | A 2000-298450 | 10/2000 |
| JP | A 2000-305532 | 11/2000 |
| JP | A-2003-202836 | 7/2003 |

* cited by examiner

*Primary Examiner*—Amr Awad
*Assistant Examiner*—Stephen G Sherman
(74) *Attorney, Agent, or Firm*—Oliff & Berridge, PLC

(57) ABSTRACT

To correct brightness by measuring with accuracy and high speed variation of the brightness between pixels of an organic EL display. A first correction data memory stores a first correction data Dhy in a row direction, and a second correction data memory stores second correction data Dhx in a column direction. A first operation circuit generates a pixel correction data DH based on the first correction data Dhy and the second correction data Dhx. The pixel correction data DH is stored into a pixel correction data memory. Input gray scale data Din is corrected by the pixel correction data DH to output as output gray scale data Dout.

10 Claims, 14 Drawing Sheets

DH

| | | | | |
|---|---|---|---|---|
| 0 | +1 | -2 | 0 | +2 |
| +1 | +2 | -1 | +1 | +3 |
| +2 | +3 | 0 | +2 | +4 |
| -3 | -2 | -5 | -3 | -1 |
| +1 | +2 | -1 | +1 | +3 |

ELECTRO-OPTICAL DEVICE, DRIVING CIRCUIT AND DRIVING METHOD THEREOF, AND ELECTRONIC APPARATUS

BACKGROUND

The present invention relates to an electro-optical device using an electro-optical element, such as an organic light-emitting diode, a driving circuit and a driving method thereof, and an electronic apparatus.

A device having an organic light-emitting diode element (hereinafter, referred to as OLED element) has received much attention as an alternative electro-optical device to a liquid crystal display device. The OLED (organic light-emitting diode) element electrically operates as a diode, and optically emits light at forward bias to increase emission brightness according to the increase in the forward current.

Electro-optical devices having the OLED elements arranged in a matrix are classified into an active type and a passive type. However, in both cases, the current flowing through the OLED elements varies according to various factors. The active electro-optical devices comprises a plurality of scanning lines and a plurality of data lines, and a pixel circuit is arranged at each intersection of the plurality of scanning lines and the plurality of data lines. Each pixel circuit has a thin film transistor (TFT) that supplies a current to each OLED element. In the active type electro-optical devices, the current flowing through the OLED element varies according to the writing accuracy of analog data or the TFT characteristics. Further, in the passive type electro-optical devices, the current supplied to the OLED element for a certain time varies according to the resistance or the capacitance of a current path.

As a technology for improving the difference of the current flowing through the OLED element, a method is disclosed which comprises the steps of measuring the current flowing through each OLED element, generating a correction value based on the measured result, and correcting the image data (for example, see Patent Document 1).

[Patent Document] Japanese Unexamined Patent Application Publication No. 2003-202836.

SUMMARY

However, measuring the current for each pixel as described in the conventional art takes much time because the current should be measured for every pixel. In particular, for a large-screen electro-optical device having a large number of pixels, it is a considerable task.

Accordingly, the present invention has been made to solve the above-mentioned problems, and it is an object of the present invention to provide an electro-optical device, a driving circuit and a driving method thereof, and an electronic apparatus, in which image data correction can be carried out by a simple and easy measurement.

To solve the above-mentioned problems, there is provided a driving circuit for driving an electro-optical device having a pixel region in which a plurality of electro-optical elements is arranged in a matrix, comprising: correction data storage means for storing block correction data corresponding to a plurality of blocks that divide the pixel region to correct control data that controls emission brightness of the electro-optical elements; and correction means for correcting the control data based on the block correction data.

According to the present invention, since the block correction data is stored in a block unit, a storage capacity of the correction data storage means can be reduced. At this time, a phrase "based on the block correction data" refers to both a case in which the block correction data is directly used and a case in which the data is corrected by using the generated data. Preferably, the correction data storage means comprises a nonvolatile memory. In addition, a term "electro-optical element" refers to an element whose optical characteristics are changed by electrical energy. The electro-optical element comprises a self-luminescence element such as an inorganic light-emitting diode or an organic light-emitting diode. In addition, for a block division scheme, it is preferable to make variation of brightness larger for each block rather than measuring variation of brightness randomly. As variation factors, there are output variation in one driver, output variation between drivers when a plurality of drivers is used, variation in a process of forming transistors constituting pixel circuits that comprise the electro-optical elements, and variation in a process of forming the electro-optical elements. Therefore, it is preferable to divide the block such that the variation in a process of fabricating the electro-optical device is reflected.

In the above-mentioned driving circuit, the plurality of blocks comprises a plurality of block groups each being divided with different division schemes, each of the plurality of electro-optical elements belongs to more than two block groups, and the block correction data comprises a plurality types of data belonging to the plurality of block groups, and the correction means corrects the control data by using the plurality types of the block correction data. In this case, since the electro-optical elements are included in the plurality of block groups, it is possible to exactly correct the control data from the plurality types of block correction data. For example, when the electro-optical elements are arranged in m row and n column, m blocks are divided in a row direction as a first block group and n blocks are divided in a column direction as a second block group.

In the above-mentioned driving circuit, the correction means comprises operation means for performing an operation on the block correction data to generate pixel correction data for each pixel; and storage means for storing the pixel correction data. The control data is corrected by using the pixel correction data read from the storage means. In this case, the pixel correction data is stored in the storage means so that it is not necessary to always perform an operation process to generate the pixel correction data. Therefore, it is not necessary for the operation means to generate the image correction data in real time so that the configuration can be simplified. For example, it is preferable that the pixel correction data be generated by using the operation means at the initialization period immediately after applying power to the electro-optical device, and be stored into the storage means. In addition, the storage means may be a volatile memory such as SRAM or DRAM.

In the above-mentioned driving circuit, the correction means comprises specifying means for specifying a pixel to be controlled by the control data; and operation means for performing an operation on the block correction data to generate pixel correction data for the pixel specified by the specifying means. The control data is corrected by using the generated pixel correction data. In this case, since the pixel correction data is generated in real time, the storage means for storing the pixel correction data is not necessary.

In the above-mentioned driving circuit, the control data allows the emission brightness of the electro-optical element to be controllable and comprises individual control data corresponding to each of the plurality of block groups. The correction means uses the block correction data of the block group that corresponds to the individual control data to correct the corresponding individual control data. For example, when the plurality of block groups is made of a first block group divided in a row direction and a second block group divided in a column direction, in the data line driving circuit which supplies driving current or driving voltage to each data line arranged in the column direction, the correction corresponding to the first block group may be performed, and an emission period of the electro-optical element arranged in each row may be controlled by a scanning line driving circuit so that the correction corresponding to the second block group may be performed.

Next, an electro-optical device according to the present invention comprises the driving circuit; a pixel region arranged in a matrix having a plurality of electro-optical elements driven by a current; image control means for sequentially displaying image patterns corresponding to a plurality of blocks into which the pixel region is divided; current measuring means for measuring a current supplied to the electro-optical elements for each block to output the supplied current as a block current; and correction data generation means for generating the block correction data based on the difference of the block current with respect to a predetermined reference current value. With this configuration, since the electro-optical device has current measuring means, it is possible to correct the control data even when the electrical characteristics of constituent elements of the electro-optical device is changed due to a change over time. Here, the electro-optical element may be an organic light-emitting diode.

Next, an electronic apparatus according to the present invention comprises the electro-optical device as a display unit, and the electronic apparatus is, for example, a mobile phone, a personal computer, a digital camera, a PDA and a calculator.

Next, a method of driving an electro-optical device which comprises a pixel region in which a plurality of electro-optical elements is arranged in a matrix; control data generation means for controlling emission brightness of the electro-optical elements; and storage means for storing block correction data to correct control data of each block for each of a plurality of block groups into which the pixel region is divided with different division scheme, the method comprising the steps of: performing an operation on a plurality types of the block correction data to generate pixel correction data for each pixel; storing the generated pixel correction data; and correcting the control data by using the stored pixel correction data. With this method, since the pixel correction data is stored, it is not necessary to always perform an operation processing to generate the pixel correction data. Therefore, load of the operation processing may be reduced.

In addition, a method of driving an electro-optical device which comprises a pixel region in which a plurality of electro-optical elements is arranged in a matrix; control data generation means for controlling emission brightness of the electro-optical elements; and storage means for storing block correction data to correct control data of each block for each of a plurality of block groups into which the pixel region is divided with different division schems, the method comprising the steps of: specifying a pixel to be controlled by the control data; performing an operation on the block correction data to generate pixel correction data for the specified pixel; and correcting the control data by using the generated pixel correction data. With this method, the pixel correction data can be generated in real time so that it is not necessary to store the pixel correction data.

In addition, a method of driving an electro-optical device which comprises a pixel region in which the plurality of electro-optical elements is arranged in a matrix; and storage means for storing block correction data to correct the control data of each block for each of the plurality of block groups into which the pixel region is divided with different division schems, the method comprising the steps of: generating control data to control emission brightness of the electro-optical elements, wherein the control data includes individual control data corresponding to each of the plurality of block groups; and correcting the individual control data by using the block correction data of the block group corresponding to the individual control data. By performing correction in a block unit, the correction processing can be made easily and simply.

In addition, the method of driving the electro-optical device comprises the steps of: driving the electro-optical element with a current; sequentially displaying image patterns respectively corresponding to the plurality of blocks into which the pixel region is divided; measuring the current supplied to the electro-optical element for each block as a block current; and generating the block correction data based on the difference of the block current with respect to a predetermined reference current value. With this method, since the current measurement is performed, it is possible to correct the control data even though the electrical characteristics of the constituent elements of the electro-optical device are changed due to a change over time.

DETAILED DESCRIPTION OF EMBODIMENTS

1 First Embodiment

Figure 1:
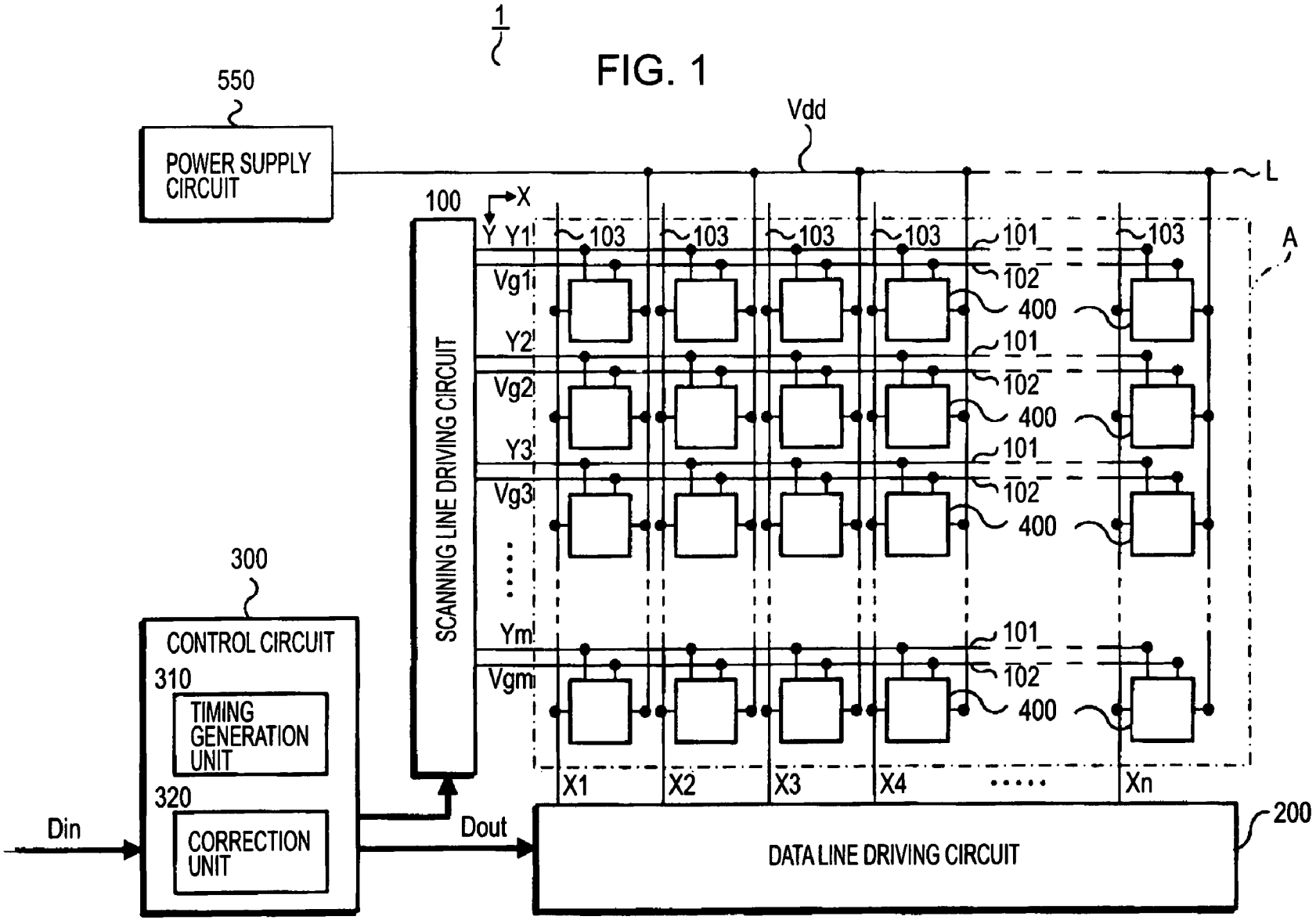
FIG. 1 is a block diagram showing a configuration of an electro-optical device 1 according to a first embodiment of the present invention.

FIG. 1 is a block diagram showing a schematic configuration of an electro-optical device 1 according to a first embodiment of the present invention. The electro-optical device 1 comprises a pixel region A, a scanning line driving circuit 100, a data line driving circuit 200, a control circuit 300, and a power supply circuit 550. Here, m scanning lines 101 and m emission control lines 102 are provided parallel to the X direction in the pixel region A. In addition, n data lines 103 are provided perpendicular to X direction and parallel to Y direction. Further, pixel circuits 400 are arranged correspondingly at the intersections of the scanning lines 101 and the data lines 103. The pixel circuit 400 comprises an OLED element. In addition, each of the pixel circuits 400 is supplied with a power supply voltage Vdd through a power supply line L.

Figure 2:
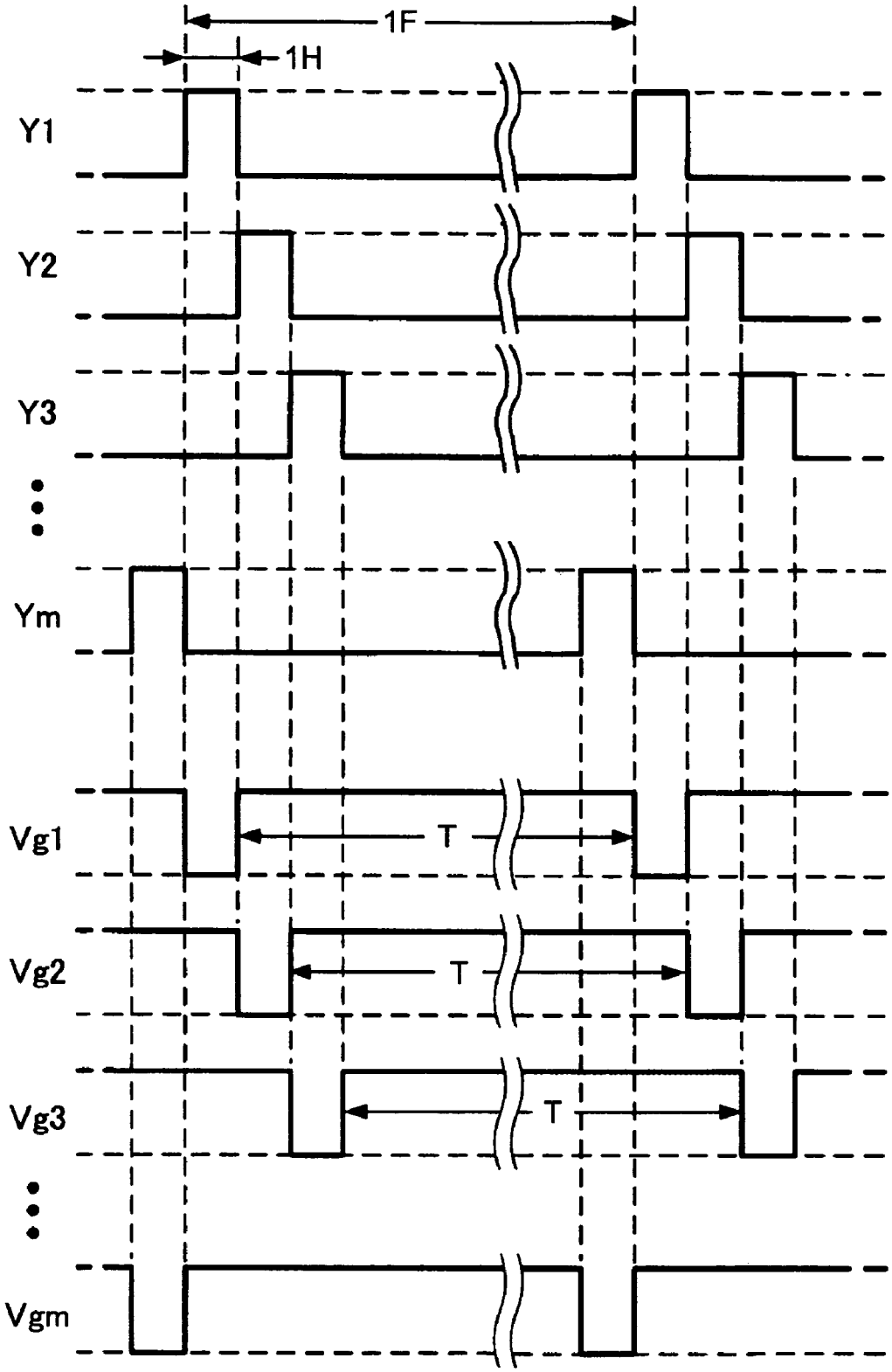
FIG. 2 is a timing chart of a scanning line driving circuit in the electro-optical device according to the first embodiment of the present invention.

The scanning line driving circuit 100 generates scanning signals Y1, Y2, Y3, . . . and Ym for sequentially selecting the plurality of scanning lines 101, and generates emission control signals Vg1, Vg2, Vg3, . . . , and Vgm. The scanning signal Y1 is generated by sequentially transmitting a Y transmission start pulse DY in synchronization with a Y clock signal YCLK. The emission control signals Vg1, Vg2, Vg3, . . . , and Vgm are supplied to the respective pixel circuits 400 through the emission control lines 102. FIG. 2 shows an example of a timing chart of the scanning signals Y1 to Ym and the emission control signals Vg1 to Vgm.

The scanning signal Y1, which is a pulse having a width corresponding to one horizontal scanning period (1H) from an initial timing of one vertical scanning period (1F), is supplied to a first row of scanning line 101. Then, by shifting this pulse sequentially, scanning signals Y2, Y3, . . . , and Ym are supplied to 2, 3, . . . , and mth rows of scanning lines 101, respectively. In general, when the scanning signal Yi supplied to ith (i is an integer, $1 \leqq i \leqq m$) row of scanning line 101 becomes an H level, it represents that the corresponding scanning line 101 is selected. In addition, as the emission control signals Vg1, Vg2, Vg3, . . . , and Vgm, the signals with the inverted logic levels of the scanning signals Y1, Y2, Y3, . . . , and Ym are used.

The data line driving circuit 200 supplies gray scale signals X1, X2, X3, . . . , and Xn to the respective pixel circuits 400 located in the selected scanning line 101 on the basis of output gray scale data Dout. In this example, the gray scale signals X1 to Xn are supplied to the pixel circuits as current signals indicating gray scale brightness. The data line driving circuit 200 comprises a shift register, a latch circuit, and a current output type of D/A converter corresponding to each of the n data lines 103. The shift register sequentially transmits an X transmission start pulse DX in synchronization with an X clock signal XCLK to generate a latch signal. The latch circuit uses the latch signal to latch an output gray scale data Dout. The output signals are D/A-converted by the D/A converter, and then the gray scale signals X1 to Xn are generated.

The control circuit 300 comprises a timing generation unit 310 and a correction unit 320. The timing generation unit 310 generates various control signals, such as a Y clock signal YCLK, a X clock signal XCLK, an X transmission start pulse DX, and a Y transmission start pulse DY, and outputs these signals to the scanning line driving circuit 100 and the data line driving circuit 200. In addition, the correction unit 320 performs a correction processing on the input gray scale data Din externally supplied and outputs an output gray scale data Dout. The correction unit 320 will be described below in more detail.

Figure 3:
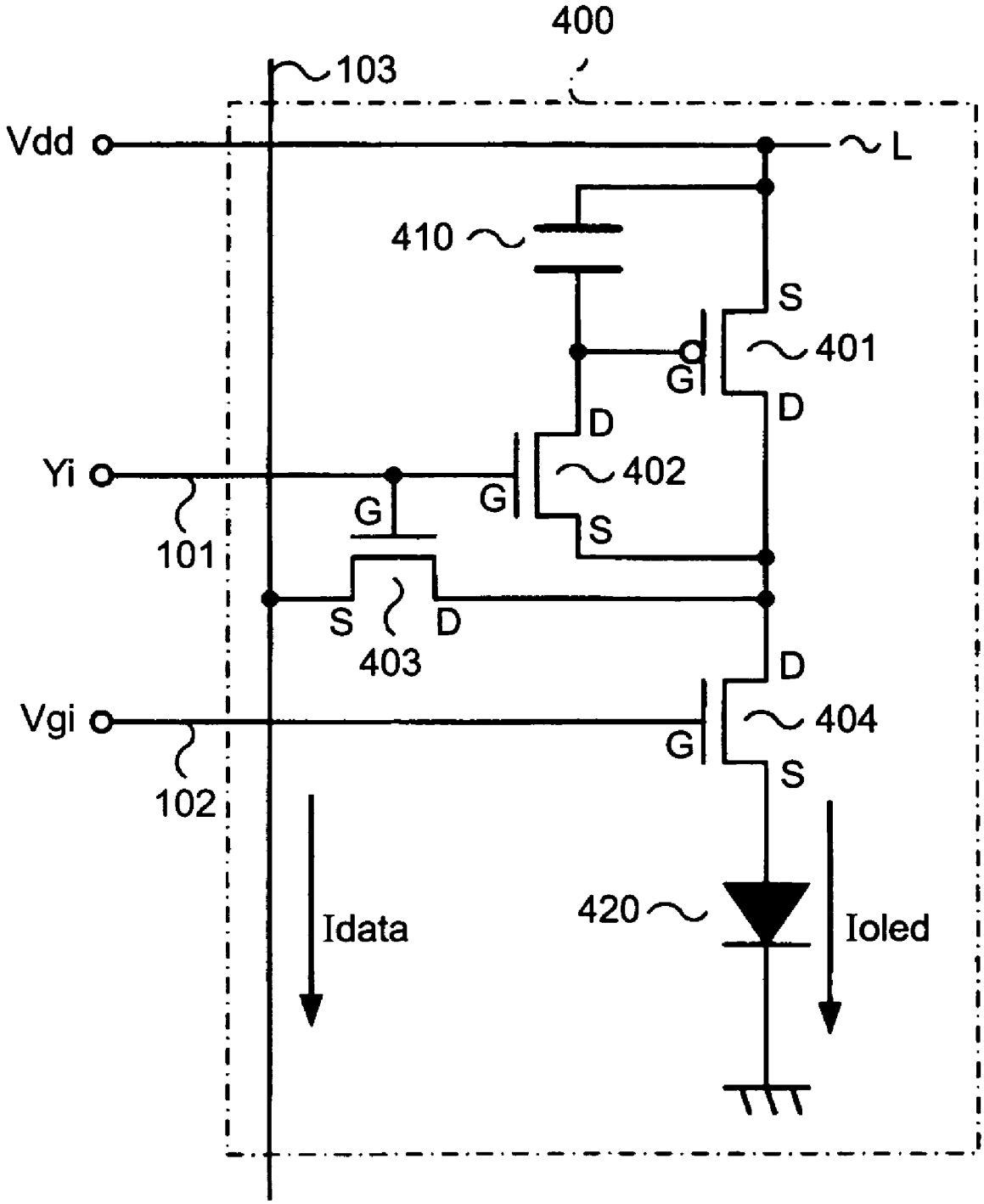
FIG. 3 is a circuit diagram showing a configuration of a pixel circuit in the electro-optical device according to the first embodiment of the present invention.

Next, the pixel circuit 400 will now be described. FIG. 3 shows a circuit diagram of a pixel circuit 400. The pixel circuit 400 shown in FIG. 3 corresponds to the ith pixel circuit, and a power supply voltage Vdd is supplied thereto. The pixel circuit 400 comprises four TFTs 401 to 404, a capacitor element 410, and an OLED element 420. In the process of fabricating the TFTs 401 to 404, a polysilicon layer is formed on a glass substrate by using a laser annealing shot. Further, in the OLED element 420, a light-emitting layer is interposed between an anode and a cathode. In addition, the OLED element 420 emits lights at the brightness according to a forward direction current. In the light-emitting layer, an organic electronic luminescence (EL) material corresponding to an emitting color is used. During the processing of fabricating the light-emitting layer, the organic EL material is ejected as droplets from a head of an inkjet type, and then dried.

The driving transistor TFT 401 is a p channel type, and the switching transistors TFTs 402 to 404 are an n channel type. A source electrode of the TFT 401 is connected to the power supply line L, while a drain electrode thereof is connected to a drain electrode of the TFT 403, a drain electrode of the TFT 404 and a source electrode of the TFT 402, respectively.

An end of the capacitor element 410 is connected to the source electrode of the TFT 401, while the other end of the capacitor element 410 is connected to a gate electrode of the TFT 401 and a drain electrode of the TFT 402, respectively. The gate electrode of the TFT 403 is connected to the scanning line 101, and the source electrode thereof is connected to the data line 103. In addition, the gate electrode of the TFT 402 is connected to the scanning line 101. Further, the gate electrode of the TFT 404 is connected to the emission control line 102, and the source electrode thereof is connected to the anode of the OLED element 420. The gate electrode of the TFT 404 is supplied with the emission control signal Vgi through the emission control line 102. Furthermore, the cathode of the OLED element 420 is a common electrode across the pixel circuit 400, which becomes a low level (reference) potential for the power supply.

With this configuration, when the scanning signal Yi becomes the H level, the n channel type TFT 402 is turned on so that the gate electrode and the drain electrode of the TFT 401 function as a junction diode. When the scanning signal Yi becomes the H level, the n channel type TFT 403 is also turned on in the same manner as the TFT 402. As a result, the current Idata of the data line driving circuit 200 flows along the following path: power supply line L→TFT 401→TFT 403→data line 103. At this time, a charge corresponding to the potential of the gate electrode of the TFT 401 is accumulated into the capacitor element 410.

When the scanning signal Yi becomes an L level, the TFTs 403 and 402 are all turned off. At this time, the input impedance in the gate electrode of the TFT 401 is extremely high so that the state of the charge accumulation in the capacitor element 410 is not changed. The voltage between the gate electrode and the source electrode of the TFT 401 remains a voltage at the time that the current Idata flows. In addition, when the scanning signal Yi becomes an L level, the emission control signal Vgi becomes an H level. For this reason, the TFT 404 is turned on, and an injection current Ioled according to the gate voltage flows between the source electrode and the drain electrode of the TFT 401. Specifically, the current flows along the following path: power supply line L→TFT 401→TFT 404→OLED element 420.

Here, the injection current Ioled that flows into the OLED element 420 is determined according a voltage between the gate and the source of the TFT 401, while when the current Idata flows into the data line 103 by the scanning signal Yi having the H level, the voltage is one retained by the capacitor element 410. For this reason, when the emission control signal Vgi becomes the H level, the injection current Ioled flowing into the OLED element 420 is approximately equivalent to the current Idata that flows immediately before. As such, the pixel circuit 400 specifying emission brightness by means of the current Idata is a current programming circuit.

Figure 4A:
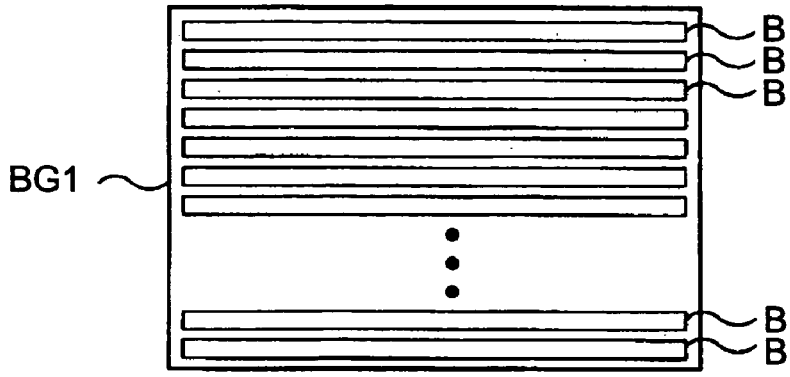
FIG. 4 is a diagram for explaining a block pattern of a pixel area A.
Figure 4B:
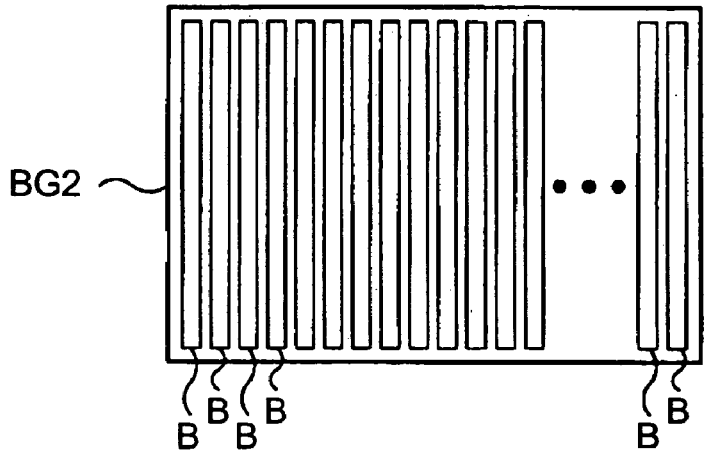

The emission brightness of the OLED element 420 corresponds to the injection current Ioled, while in the actual electro-optical device 1, the injection current Ioled is varied due to various factors. For this reason, brightness irregularity is generated to degrade a display quality of the electro-optical device 1. Considering the variation of the injection current Ioled, the pixel region A can be divided into a block B as shown in FIG. 4. The pixel area A is divided in a row direction in FIG. 4A, is divided in a column direction in FIG. 4B, is divided according to the row and column location in FIG. 4C, and is bisected at the right side and the left side in FIG. 4D.

As described above, the data line driving circuit 200 comprises n current output type of D/A converters. Therefore, when the characteristics of the D/A converters are varied, the emission brightness between the blocks B shown in FIG. 4B is also varied.

In addition, the TFTs 401 to 404 of the pixel circuit 400 are formed by using laser annealing shot as described above. During the laser annealing process, a plurality of laser sources is scanned in a predetermined direction. For this reason, the amount of light between the laser sources is varied, and the amount of light may be varied during the scanning process. The variation of the amount of light affects the electrical characteristic of the polysilicon layer so that the electrical characteristics of the TFTs 401 to 404 are also varied. For example, when the scanning direction of the laser annealing shot is performed in a column direction, the emission brightness between the blocks B shown in FIG. 4B is varied due to the different amount of light of the laser source, and the emission brightness is also varied between the blocks B shown in FIG. (4A) due to the different amount of light during the process of scanning.

Figure 4C:
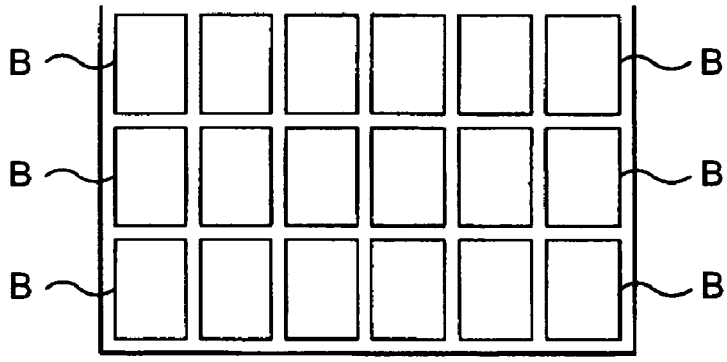

In addition, the light-emitting layer of the OLED element 420 is formed by being applied with an organic EL material in the inkjet type and being dried as described above. During the applying process, the scanning is performed in the predetermined direction while the organic EL material is ejected as droplets from a plurality of heads. For this reason, the size of the droplets between the heads can be varied, and the size of the droplets can also be varied during the process of the scanning. Since the variation of the size of the droplets affects the electrical characteristics of the light-emitting layer, the emission characteristic of the OLED element 420 is also varied. For example, when the scanning direction of the inkjet is in a row direction, the emission brightness between the blocks B shown in FIG. 4A is varied due to the different amount of the droplets between heads, and the emission brightness between the blocks B shown in FIG. 4B is also varied due to the different amount of the droplets during the process of scanning. In addition, the electrical characteristic of the light-emitting layer is also varied due to the heat gradient in the drying process. For this reason, the emission brightness is varied according to a location of the pixel region A of the OLED element 420. Therefore, the emission brightness between the blocks shown in FIG. 4C is varied.

Figure 4D:
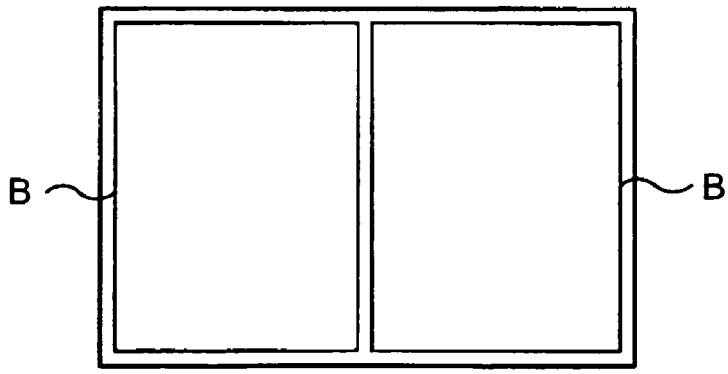

Moreover, the above-mentioned data line driving circuit 200 may be composed of a plurality of IC modules. In this case, when the electrical characteristics between the IC modules are varied, the emission brightness is also varied. For example, when the data line driving circuit 200 is composed of two IC modules, the emission brightness between the blocks shown in FIG. 4D is varied. In the following description, a collection of blocks B divided from the pixel region A according to the predetermined rules is referred to as a block group BG, as shown in FIGS. 4A to 4D.

As described above, the emission brightness is proportional to the injection current Ioled to the OLED element 420. In addition, the power supply current for a case where the only the OLED element 420 of one pixel is emitted is the injection current Ioled of the corresponding OLED element 420. Therefore, the variation of the brightness between the pixels can be specified from the variation of the injection current Ioled. Furthermore, when the block current Ib is set to the power supply current for a case where only the OLED element 420 of any block B is emitted, the injection current Ioled for each pixel can be specified from a plurality of block currents Ib that belongs to the different block groups BG. For example, when a collection of blocks B divided in a row direction as shown in FIG. 4A are referred to as a first block group BG1 and a collection of blocks B divided in a column direction as shown in FIG. 4B are referred to as a second block group BG2, the injection current Ioled of the pixel located at the first row and the first column can be specified based on the first row of block current Ib belonging to the first block group BG1 and the first column of block current Ib belonging to the second block group BG2. According to the present embodiment, the block current Ib is measured for the first block group BG1 and the second block group BG2, and a correction data Dh that corrects the variation of the brightness is generated in advance based on the measured block current Ib, and is stored into the nonvolatile memory. The correction data Dh of this example comprises a first correction data Dhy corresponding to the m blocks B divided in a row direction and second correction data Dhx corresponding to n blocks B divided in a column direction. The correction unit 320 comprises a nonvolatile memory in which the first correction data Dhy and the second correction data Dhx are stored. In addition, the writing of data into the nonvolatile memory is preferably performed based on the result of the measurement after the block current Ib is measured during the testing process of the electro-optical device 1.

Figure 5:
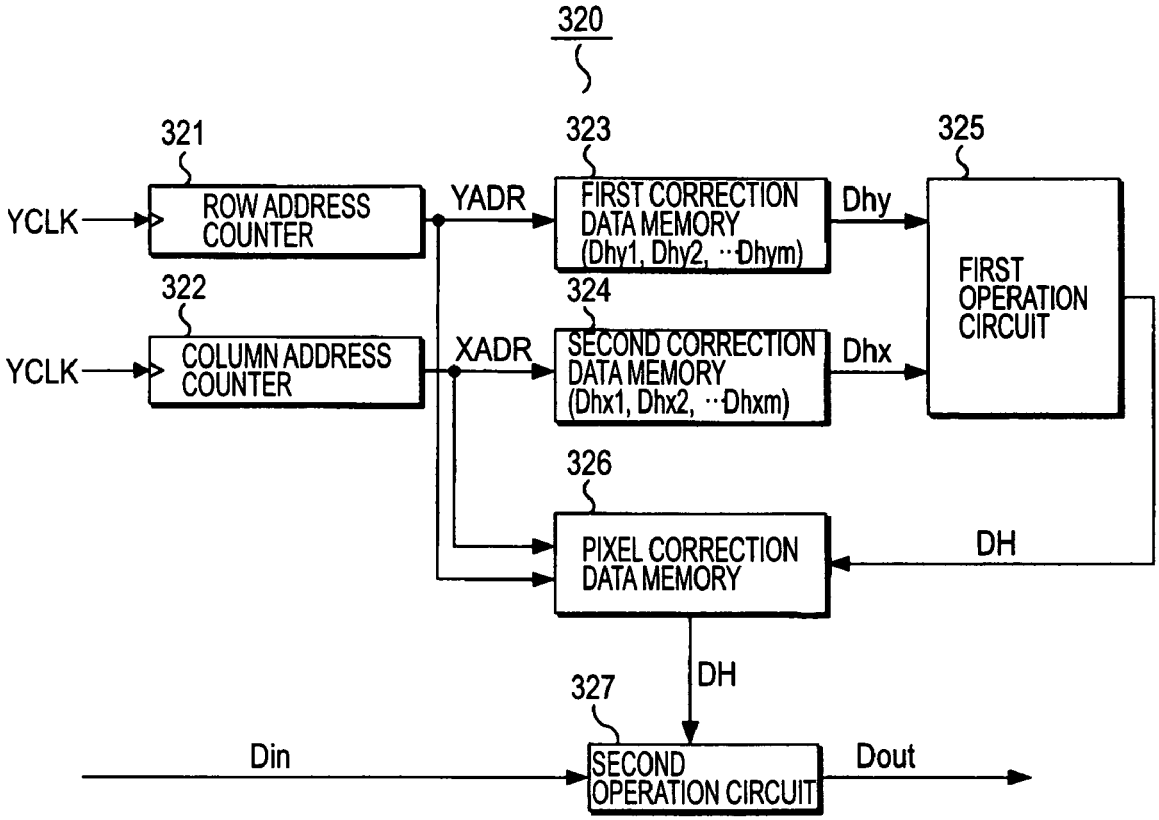
FIG. 5 is a block diagram showing a configuration of a correction unit in the electro-optical device according to the first embodiment of the present invention.

FIG. 5 shows a block diagram of the correction unit 320. The correction unit 320 comprises a row address counter 321 that counts a Y clock signal YCLK to output a row address signal YADR, and a column address counter 322 that counts an X clock signal XCLK to output a column address signal XADR. The first correction data memory 323 and the second correction data memory 324 are nonvolatile memories that store in advance the first correction data Dhy and the second correction data Dhx, respectively. The first correction data Dhy comprises m data, i.e., Dhy1, Dhy2, . . . , and Dhym, and the second correction data Dhx comprises n data, i.e., Dhx1, Dhx2, . . . , and Dhxn. Further, when the row address signal YADR indicating the ith row is supplied to the first correction data memory 323, the first correction data Dhyi is output, and when the column address signal XADR indicting jth column is supplied to the second correction data memory 324, the second correction data Dhxj is output.

The operation circuit 325 performs an operation process on the first correction data Dhy and the second correction data Dhx to generate the pixel correction data DH. The pixel correction data DH indicates a correction value for each pixel, and the pixel correction data DHij at ith row and jth column is generated based on the ith row of the first correction data Dhyi and the jth column of the second correction data Dhxj.

The generated pixel correction data DH is stored into the pixel correction data memory 326. The pixel correction data memory 326 comprises volatile memories such as SRAM or DRAM. In addition, the pixel correction data DH is generated based on the first correction data Dhy and the second correction data Dhx, and a series of processing that stores these into the pixel correction data memory 326 is performed during an initialization period immediately after supplying the power supply to the electro-optical device 1. Therefore, in the display period continued during the initialization, since it is possible to read the pixel correction data DH from the pixel correction data memory 326, it is not necessary to generate the pixel correction data DH in real time.

Further, for the display period, the row address signal YADR and the column address signal XADR are supplied to the pixel correction data memory 326, and the pixel correction data DH of the designated pixel is read. The second operation circuit 327 uses the pixel correction data DH to correct the input gray scale data Din and generate the output gray scale data Dout.

The operation processing of the first operation circuit 325 can perform add, subtraction, multiplication and division or a combination thereof. This is also applied to the operation processing of the second operation circuit 327. Furthermore, at least one of the first and second operation circuits 325 and 327 can be replaced by a lookup table storing these values such that input values correspond to out values. When the lookup table is employed, a nonlinear characteristic exists between the input values and the output values.

Here, when each pixel emits light at the predetermined brightness, the value of the injection current Ioled corresponding to the predetermined brightness is a reference current value Iref. In the actual electro-optical device 1, the value of the injection current Ioled is varied over the reference current value Iref, due to the various factors illustrated in FIG. 4. The above-mentioned first correction data Dhy is data that corrects the variation in the row direction for each block B, and the second correction data Dhx is data that corrects the variation in the column direction for each block B. For example, when the variation of the pixel is given as a summation of the variation in the row direction and the variation in the column direction, the pixel correction data DHij at ith row and jth column is represented by the following equation 1.

$$Dhij=Dhyi+Dhxj \quad (1)$$

In this case, the first operation circuit 325 comprises an add circuit.

Figures 6, 7:
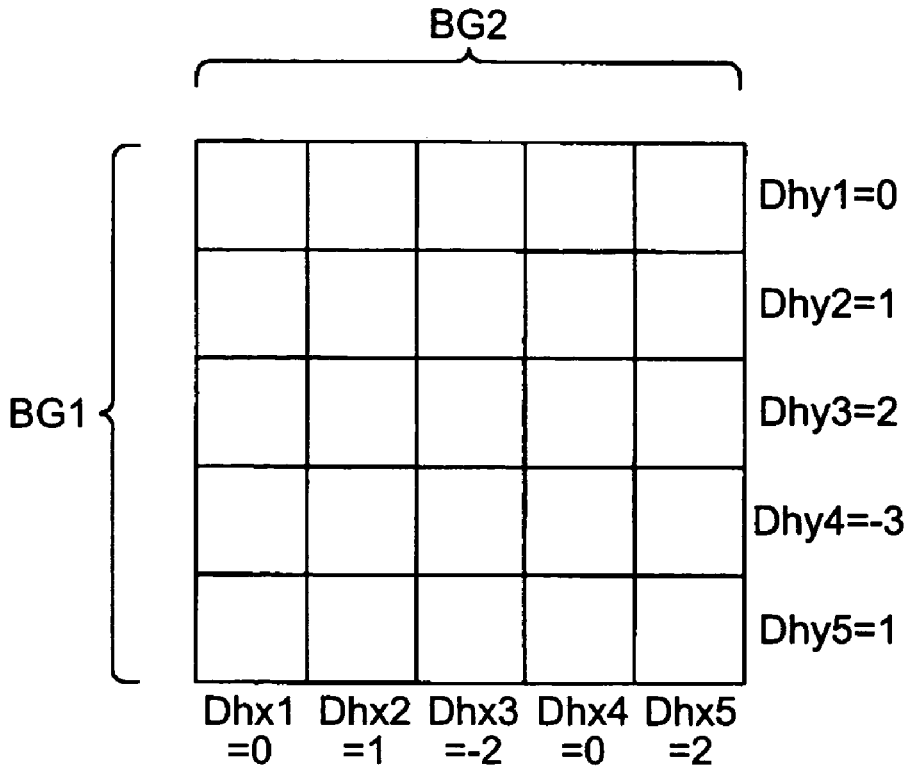
FIG. 6 is a diagram for explaining an example of first and second correction data used for the electro-optical device according to the first embodiment of the present invention.
FIG. 7 is a diagram for explaining an example of pixel correction data used for the electro-optical device according to the first embodiment of the present invention.

For example, it is supposed that the pixel region A is made of blocks B consisting of five rows and five columns. In addition, as shown in FIG. 6, the first correction data Dhy corresponding to the first block group BG1 is Dhy1=0, Dhy2=1, Dhy3=2, Dhy4=−3, Dhy5=1, and the second correction data Dhx corresponding to the second block group BG2 is Dhx1=0, Dhx2=1, Dhx3=−2, Dhx4=0, Dhx5=2. In this case, the pixel correction data DH is shown in FIG. 7.

In addition, when the variation of the pixel is given as a multiplication between the variation in the row direction and the variation in the column direction, the pixel correction data DHij at the ith row and the jth column is represented by the following equation 2.

$$DHij=Dhyi\times Dhxj \quad (2)$$

In this case, the first operation circuit 325 comprises a multiplication circuit.

As described above, according to the present embodiment, the pixel correction data HD is not stored into the nonvolatile memory in advance, but the first correction data Dhy and the second correction data Dhx can be stored into the nonvolatile memory for each block group, so that the required storage capacity of the nonvolatile memory can be significantly reduced. In the process of generating the correction data according to the electrical characteristic of the electro-optical device 1, it is not necessary to measure the injection current Ioled for each pixel, but is enough with the measurement for each block B. Therefore, a time to generate the correction data can be significantly reduced. For example, in a case where the pixel region A consists of m rows and n columns, if the variation for each pixel is directly measured, n·m times measurement is required, but according to the present embodiment that measures for each block group BG, it is possible to complete the measurement only with n+m times.

2 Second Embodiment

The second embodiment herein is different from the first embodiment in that, in the first embodiment described above, the first correction data Dhy and the second correction data Dhx are stored in advance into the nonvolatile memory, while in an electro-optical device 2 according to the second embodiment, the first correction data Dhy and the second correction data Dhx are generated by measuring the power supply current.

Figure 8:
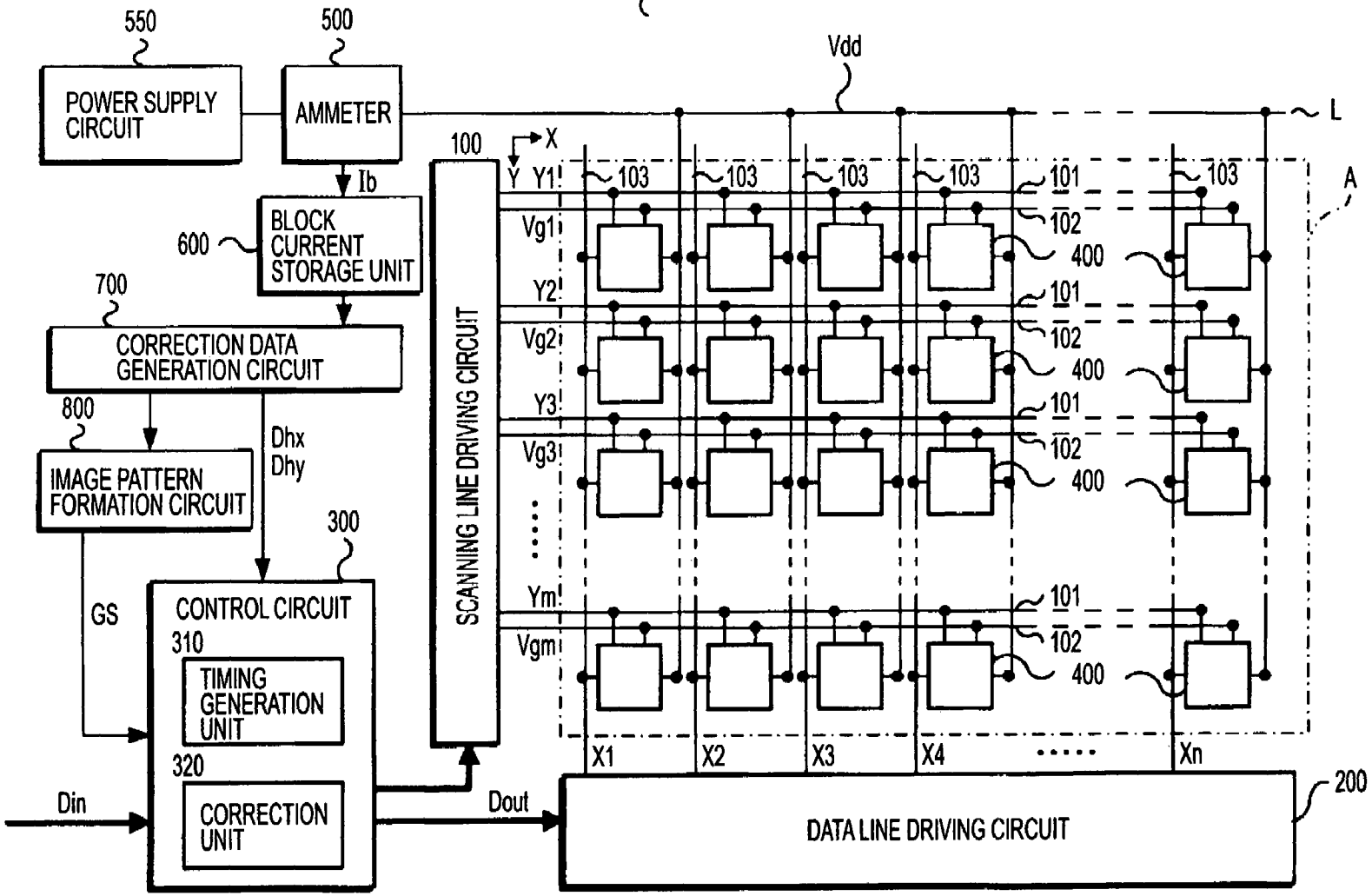
FIG. 8 is a block diagram showing a configuration of an electro-optical device 2 according to a second embodiment of the present invention.

FIG. 8 is a block diagram showing a configuration of the electro-optical device 2 according to the second embodiment of the present invention. An ammeter 500 outputs the measurement result of the power supply current flowing through a power supply line L to a block current storage unit 600. The block current storage unit 600 stores the power supply current value as a value of a block current Ib. The correction data generation circuit 700 generates the first correction data Dhy and the second correction data Dhx based on the value of the block current Ib stored in the block current storage unit 600. In addition, the correction data generation circuit 700 outputs an indication signal that indicates an image pattern to an image pattern formation circuit 800. The image pattern formation circuit 800 generates image pattern signals GS that emit light at the predetermined brightness for each block B of the first block group BG1 and the second block group BG2, and outputs the image pattern signals GS to the control circuit 300 one after another.

Figure 9:
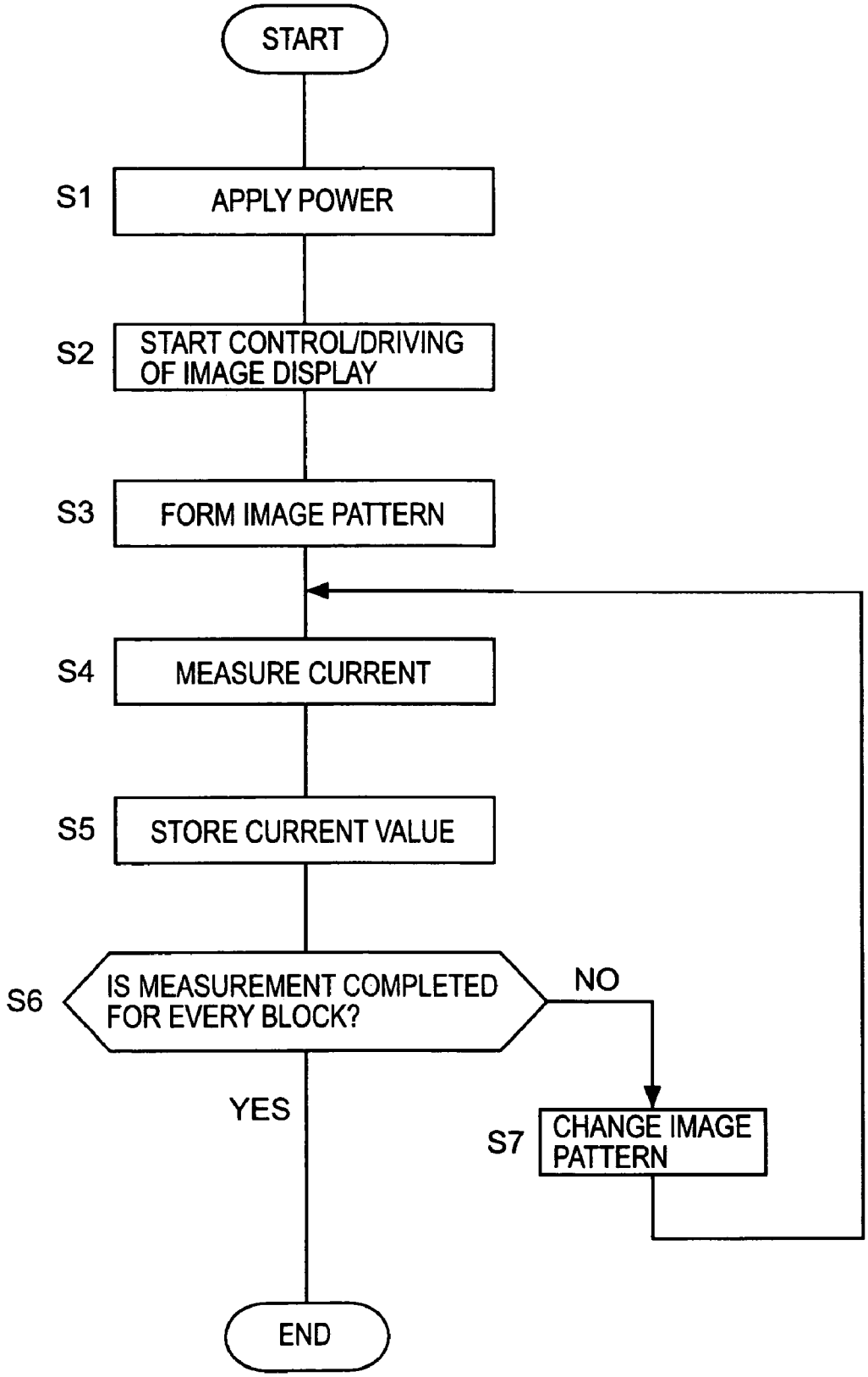
FIG. 9 is a flow chart showing a measuring process of the electro-optical device according to the second embodiment of the present invention.

With the above configuration, the block current Ib is measured for every block B, and the correction data Dh is then generated. FIG. 9 is a flow chart showing a process of measuring the block current Ib. First, a power is applied to the electro-optical device 2 (step S1). Next, the control/driving of the image display starts in the electro-optical device 2 (step S2). Next, the correction data generation circuit 700 generates an indication signal such that image patterns are generated in the order of the first block group BG1 and the second block group BG2, and accordingly, the image pattern formation circuit 800 generates the image pattern signal GS (step S3). Specifically, the image pattern that emits light for each block B of the first block group BG1 is formed in the following order: first row→second row→, . . . , and→mth row.

Subsequently, the image pattern that emits light for each block B of the second block group BG2 is formed in the following order: first column→second column→, . . . , →nth column. Here, the image pattern is set such that the object block B has the uniform and predetermined brightness, and that the brightness between the blocks is equal to each other.

Next, when any block B emits light, the power supply current is measured using the ammeter 500 (step S4). This power supply current becomes the block current Ib. Next, the measured block current Ib is stored into the block current storage unit 600 (step S5). Subsequently, the correction data generation circuit 700 determines whether the measurement is completed for every block B (step S6). When the determination at the step S6 is negative, the correction data generation circuit 700 outputs the indication signal that indicates the next image pattern, and the image pattern formation circuit 800 receives this signal to change the image pattern signal GS and supply the changed image pattern signal GS to the electro-optical device 2. Furthermore, when the measurement is completed for every block B, the processing of the measurement of the block current Ib is ended.

Next, the correction data generation circuit 700 generates the first correction data Dhy and the second correction data Dhx based on the block current Ib. The first correction data Dhy and the second correction data Dhx are obtained by, for example, the following equations (3) and (4).

$$Dhy=-(\text{current per row/pixel number per 1 row}-Iref) \quad (3)$$

$$Dhx=-(\text{current per column/pixel number per 1 column}-Iref) \quad (4)$$

The first correction data Dhy and the second correction data Dhx generated as described above are stored into the first correction data memory 323 and the second correction data memory 324 of the correction unit 320, respectively. While the first correction data memory 323 and the second correction data memory 324 are made of a nonvolatile memory in the first embodiment, it is preferable to use a volatile memory in the second embodiment from a viewpoint that the writing is facilitated.

As described above, according to the second embodiment of the present invention, it is not necessary to measure the injection current Ioled for each pixel, and it is possible to complete the measurement in a short time because the injection current Ioled is measured for each block B to generate the first correction data Dhy and the second correction data Dhx. In addition, the electro-optical device 2 has the measurement function so that it is possible to perform a correction processing according to the change over time and the environment such as the temperature characteristics and the external light.

Figure 10:
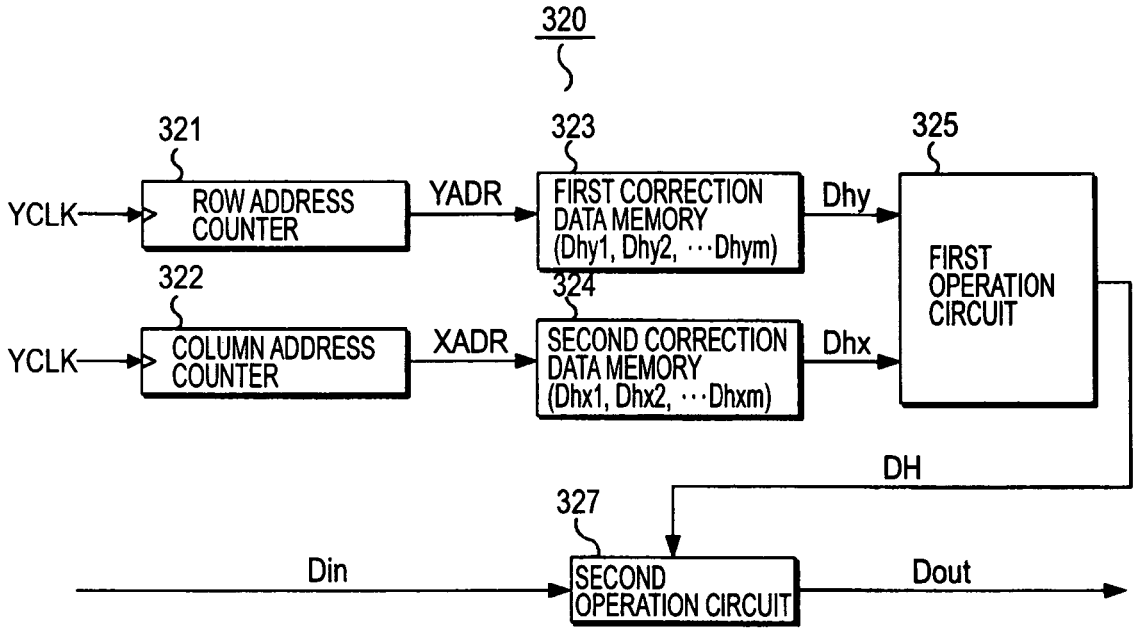
FIG. 10 is a block diagram showing a configuration of a correction unit according to an application example.

3 APPLICATION EXAMPLE (1) According to the first and second embodiments described above, the pixel correction data memory 326 is provided in the correction unit 320. However, as shown in FIG. 10, the pixel correction data memory 326 can be omitted. In this case, although it is necessary for the first operation circuit 325 to generate the pixel correction data DH in real time, it is possible to reduce the memory capacity.

Figure 11:
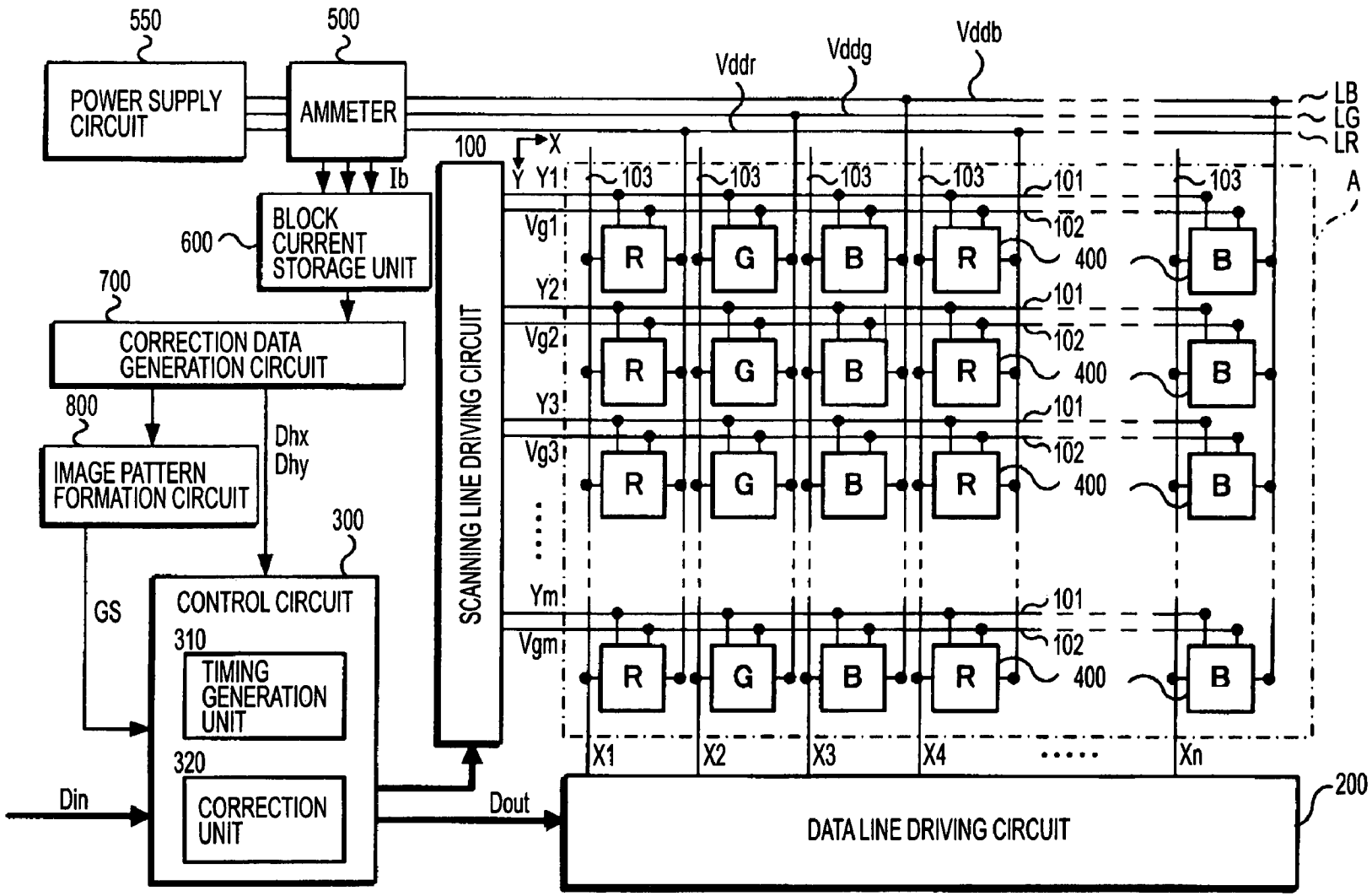
FIG. 11 is a block diagram showing a configuration of an electro-optical device according to the application example.

(2) While the monochrome electro-optical device 1 or 2 is exemplified in the above-mentioned first and second embodiments, the present invention is not limited thereto, and it is possible to implement a color display electro-optical device 1 or 2. In this case, it can be understood that the OLED element 420 having plural types of emitting colors can be used, or alternatively, a combination of the monochrome OLED element and the color conversion layer such as a color filter can also be used. In the former case, the electro-optical device 2 may be formed used as shown in FIG. 11, for example. In FIG. 11, the reference numerals 'R', 'G', and 'B' refer to 'red', 'green' and 'blue' colors, respectively, representing the emitting color of the OLED element 420. In this example, the pixel circuit 400 of each color is arranged along the data line 103. In addition, among pixel circuits 400, the pixel circuits 400 corresponding to R color are connected to the power supply line LR, the pixel circuits 400 corresponding to G color are connected to the power supply line LG, and the pixel circuits 400 corresponding to B color are connected to the power supply line LB. The power supply voltages Vddr, Vddg, and Vddb are supplied to the pixel circuit 400 for each RGB color through the power supply lines LR, LG and LB.

Figure 12:
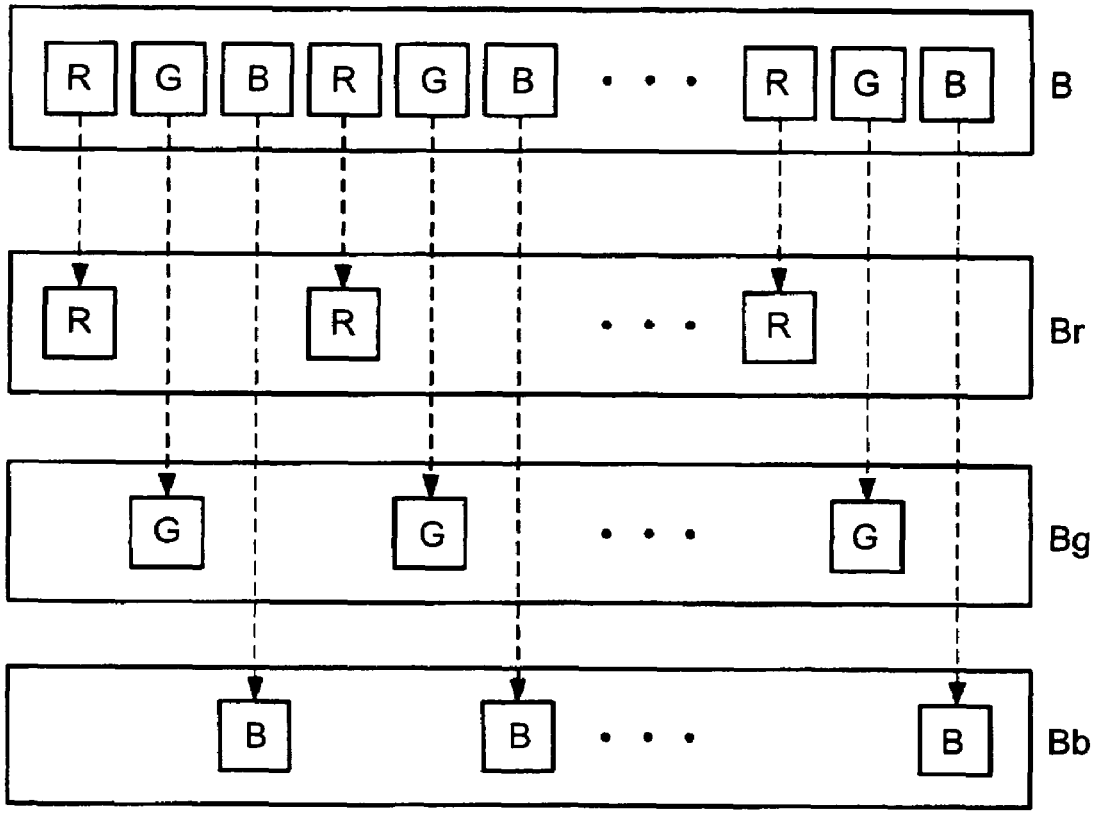
FIG. 12 is a diagram for explaining a block that constitutes a block in a color display type of electro-optical device.

Furthermore, the ammeter 500 detects the currents flowing through the respective power supply lines LR, LG and LB. Referring to FIG. 12, the block B of the first block group BG1 in the row direction will be described. As shown in FIG. 12, RGB colored pixels are respectively arranged in the block B in the row direction. In the OLED elements 420 having the different emitting colors, the emission efficiency are different from each other so that the reference current values Iref are also different from each other. For this reason, it is necessary to generate the correction data Dh according to the emitting color. Therefore, considering the block B shown in FIG. 12 as a collection of the sub-blocks Br, Bg and Bb for each emitting color, it is desirable that the block current Ib for each of the sub-blocks Br, Bg and Bb be measured and the first correction data Dhy and the second correction data Dhx be generated.

Moreover, in this example, the ammeters 500 are provided at the respective power supply lines LR, LG and LB so that the block current Ib corresponding to each RGB color can be simultaneously measured. However, it is also possible to sequentially display the image patterns corresponding to each color by using one ammeter 500.

Figure 13:
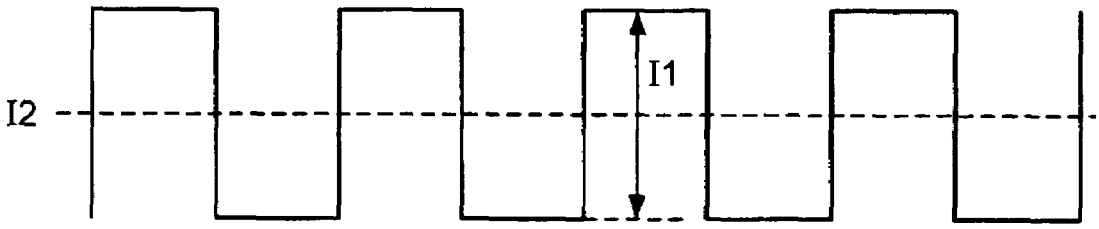
FIG. 13 is a diagram for explaining a measuring process of a power supply current according to the application example.

(3) In the above-mentioned second embodiment and the application example, the ammeter 500 may measure an instantaneous current at the timing that the power supply current shows a constant value at the steady state, or may measure an average current averaged for some time period. For example, for the passive type electro-optical device 1, although the power supply current varies as shown in FIG. 13, the instantaneous current becomes I1 and the average current becomes I2. In addition, for the active type electro-optical device, the power supply current can be divided into the write current (non-emission) and the emission current. In this case, the power supply current attributable to the light emission can be yielded according to the writing period, the emission period, and the ratio of the blanking period, and the written current value.

(4) In the first and second embodiments and the application example, even though the reference current value Iref is a predetermined value, the reference current value Iref can be determined according to the average brightness of the entire screen. Further, according to the above-mentioned embodiments, although the block group BS is selected mainly by the row and column directions, the block B shown in FIG. 4C and the block B shown in FIG. 4D may also be used. Furthermore, the variation is measured for each block B in the above-mentioned embodiments and the application example, but in addition to that, the variation for the whole pixel region A may be output as the measured result. In this case, the correction is roughly made over the entire electro-optical panel so that it is possible to perform the fine correct for each block B.

(5) While in the first and second embodiments and the application example, the variation of the injection current Ioled is corrected by adjusting the output gray scale data Dout, it is also possible to correct the variation of the injection current Ioled by adjusting an analog voltage, analog current supplied to the pixel circuit 400, or the emission time. The point is that if the injection current Ioled is controllable data, the injection current Ioled can be corrected. In this case, it is preferable to store the correction value of the data to be corrected.

(6) In addition, the reference current value Iref in the second embodiment may be a predetermined value as described above and may be an overall average value of the pixel region A. Furthermore, it may be either a current at the time of displaying the immediately previous image pattern or a current at the time of displaying the initial image pattern.

(7) In addition, although in the above-mentioned first and second embodiments and the application example, the pixel correction data DH is used to uniformly correct the emission brightness of the OLED element 420 for each pixel, the present invention is not limited thereto, and it is possible to make a correction using the first correction data Dhy and the second correction data Dhx in a block unit such that the emission brightness of the OLED element 420 is uniform. For example, the variation for each row may be corrected by adjusting the emission period (period T shown in FIG. 2) using the first correction data Dhy, and the variation for each column may be corrected by the data line driving circuit 200 using the second correction data Dhx.

Figure 14:
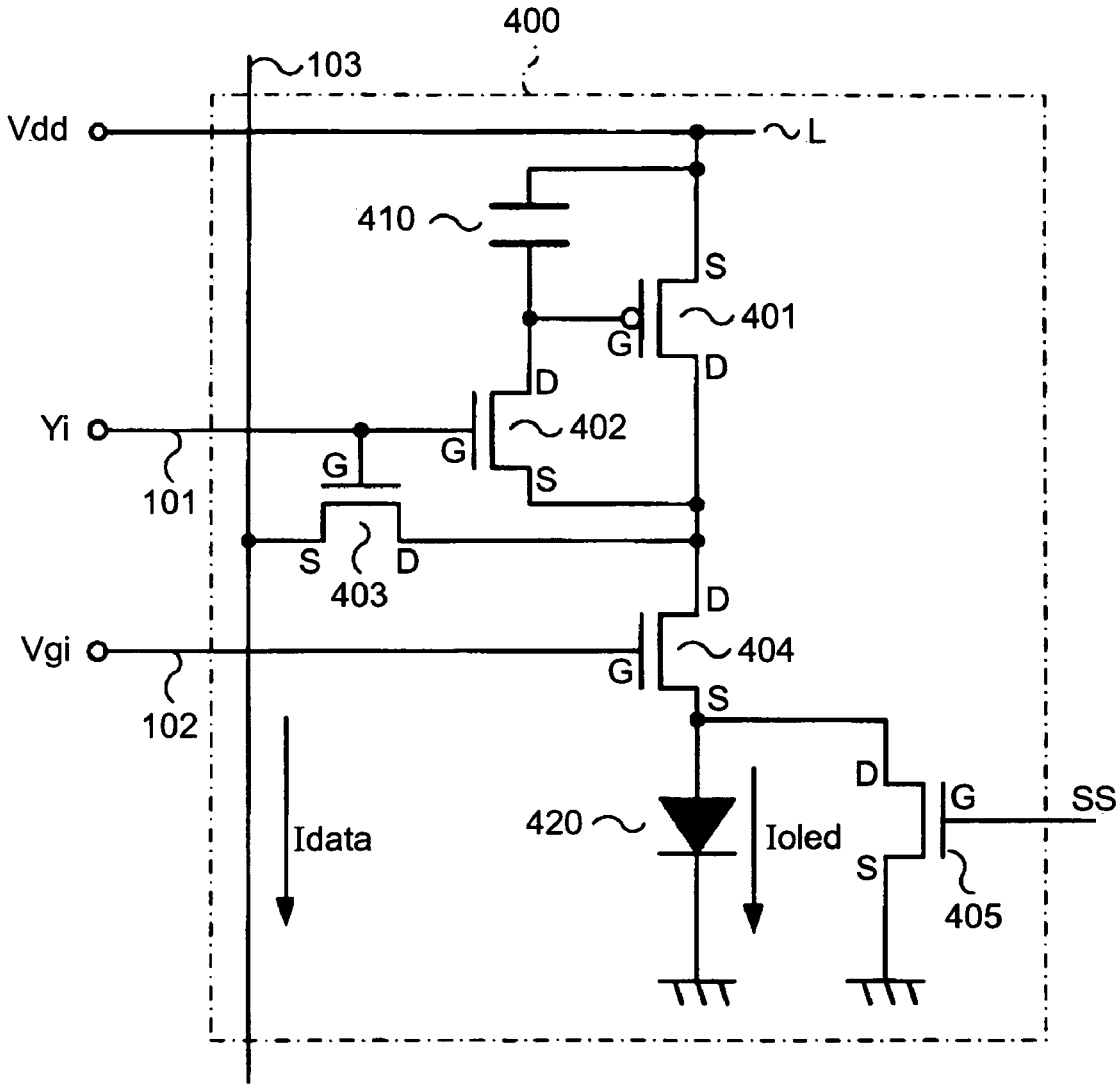
FIG. 14 is a circuit diagram showing a configuration of a pixel circuit according to the application example.

(8) Further, the pixel circuit 400 in the second embodiment can be configured as shown in FIG. 14. In this example, the OLED element 420 is arranged parallel to the TFT 405, and the lighting control signal SS is supplied to the gate of the TFT 405. The lighting control signal SS is a signal that becomes an H level in the measurement period of the block current Ib by the ammeter 500, and is generated by the control circuit 300. In this case, for the measurement period of the block current Ib, the TFT 405 is turned on and the OLED element 420 have a short circuit. As a result, the OLED element 420 is turned off. When the current flows through the OLED element 420 during the measurement period, the OLED element 420 is turned on, but in this application example, the OLED element 420 may remain turned off.

4 ELECTRONIC APPARATUS

Figure 15:
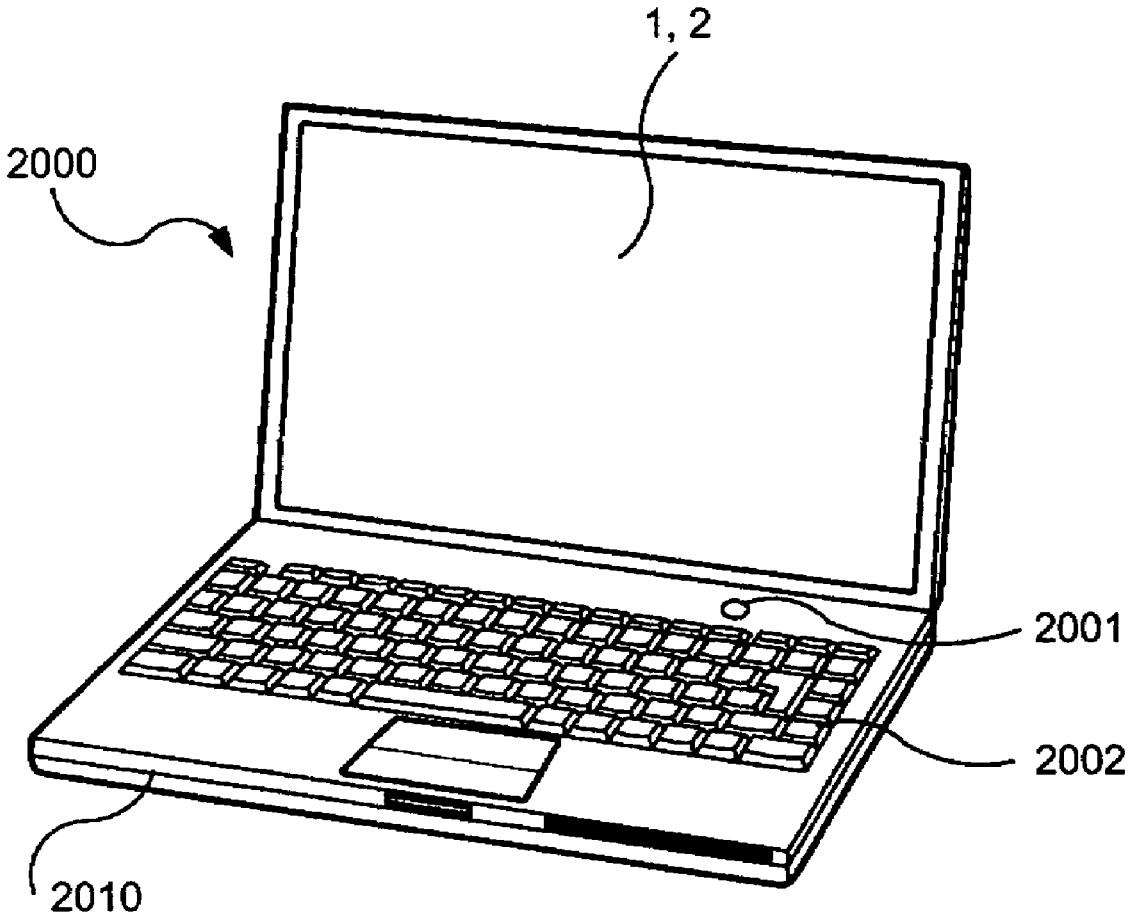
FIG. 15 is a perspective view showing a configuration of a mobile type personal computer to which the electro-optical device is applied.

Next, an electronic apparatus to which the electro-optical device 1 or 2 is applied will be described according to the above-mentioned embodiments and application example. FIG. 15 shows a configuration of a mobile type personal computer to which the electro-optical device 1 or 2 is applied. The personal computer 2000 includes a main body unit 2010 and an electro-optical device 1 as a display unit. A power supply switch 2001 and a keyboard 2002 are provided in the main unit 2010. The electro-optical device 1 can use the OLED element 420 so that it can display screen with wide viewing angle and improved visibility.

Figure 16:
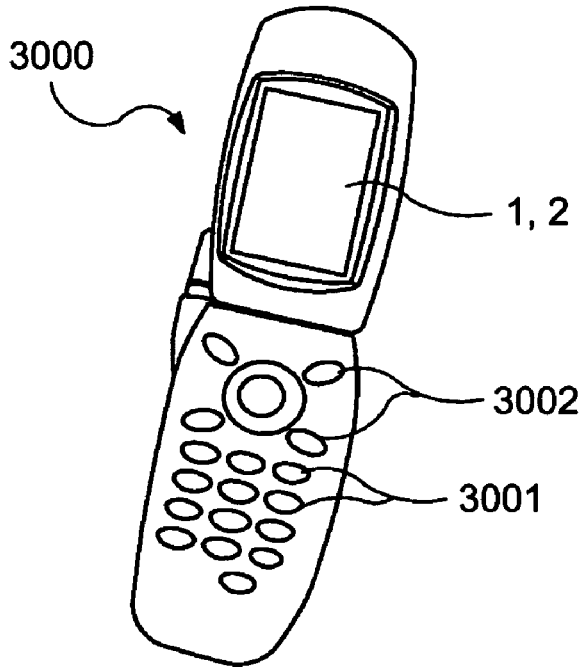
FIG. 16 is a perspective view showing a configuration of a mobile phone to which the electro-optical device is applied.

FIG. 16 shows a configuration of a mobile phone to which the electro-optical device 1 or 2 is applied. The mobile phone 3000 includes a plurality of control buttons 3001, scroll buttons 3002, and an electro-optical device 1 as a display unit. By operating the scroll buttons 3002, the displayed screen of the electro-optical device 1 is scrolled.

Figure 17:
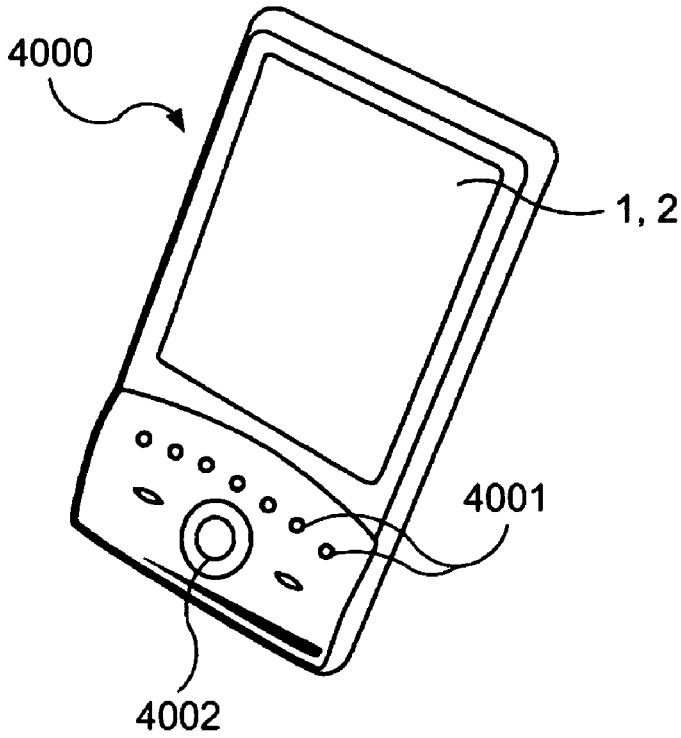
FIG. 17 is a perspective view showing a configuration of a portable digital assistance to which the electro-optical device is applied.

FIG. 17 shows a configuration of a personal digital assistant (PDA) to which the electro-optical device 1 or 2 is applied. A PDA 4000 includes a plurality of control buttons 4001, a power supply switch 4002, and an electro-optical device 1 as a display unit. By operating the power supply switch 4002, various type of information such as an address book or a scheduling book can be displayed on the electro-optical device 1.

In addition, as an electronic apparatus to which the electro-optical device 1 or 2 is applied, in addition to what are shown in FIGS. 15 to 17, a digital camera, a liquid crystal TV, a view-finder-type and monitor-direct-view-type video tape recorder, a car navigation device, a pager, an electronic note, a calculator, a word processor, a work station, a video phone, a POS terminal, and a touch panel can also be used. Furthermore, as display unit in various electronic apparatuses, the above-mentioned electro-optical device 1 can be used.

What is claimed is:

1. A driving circuit for driving an electro-optical device having a pixel region in which a plurality of electro-optical elements is arranged in a matrix, comprising:

correction data memory for storing block correction data corresponding to a plurality of blocks into which the pixel region is divided to correct control data that controls emission brightness of the electro-optical elements;

a pixel correction data memory corresponding to each electro-optical element for storing data for correcting the emission brightness of each electro-optical element;

the plurality of blocks comprising a plurality of block groups each being divided with different division schemes, each of the plurality of electro-optical elements belonging to more than two block groups, and the block correction data comprising a plurality types of data belonging to the plurality of block groups;

a first correction circuit that provides correction data to the pixel correction data memory by using the plurality types of the block correction data obtained by the different division schemes; and a second correction circuit correcting the control data by using the correction data provided to the pixel correction data memory.

2. The driving circuit according to claim 1, wherein the first correction circuit comprises:

specifying means for specifying a pixel to be controlled by the control data; and operation means for performing an operation on the block correction data to generate pixel correction data for the pixel specified by the specifying means, wherein the control data is corrected by using the generated pixel correction data.

3. The driving circuit according to claim 1, wherein the control data allows the emission brightness of the electro-optical element to be controllable and comprises individual control data corresponding to each of the plurality of block groups, and wherein the first correction circuit uses the block correction data of a block group that corresponds to the individual control data to correct the corresponding individual control data.

4. An electro-optical device comprising:

the driving circuit according to claim 1;

a pixel region arranged in a matrix having a plurality of electro-optical elements driven by a current;

image control means for sequentially displaying image patterns corresponding to a plurality of blocks into which the pixel region is divided;

current measuring means for measuring a current supplied to the electro-optical elements for each block to output the supplied current as a block current; and correction data generation means for generating the block correction data based on a difference of the block current with respect to a predetermined reference current value.

5. The electro-optical device according to claim 4, wherein the electro-optical elements are organic light-emitting diodes.

6. An electronic apparatus comprising the electro-optical device according to claim 4, as a display unit.

7. A method of driving an electro-optical device which comprises a pixel region in which a plurality of electro-optical elements is arranged in a matrix; control data generation means for controlling emission brightness of the electro-optical elements; and storage means for storing block correction data to correct control data of each block for each of a plurality of block groups into which the pixel region is divided with different division schemes, the method comprising the steps of:

storing block correction data, in block correction memory, to correct control data of each block for each of a plurality of block groups, the plurality of blocks comprising a plurality of block groups each being divided with different division schemes, each of the plurality of electro-optical elements belonging to more than two block groups, and the block correction data comprising a plurality types of data belonging to the plurality of block groups;

performing an operation on a plurality of types of the block correction data to generate pixel correction data for each pixel;

storing the generated pixel correction data for each pixel in a memory corresponding to each pixel; and correcting the control data by using the stored pixel correction data.

8. The method of driving the electro-optical device according to claim 7, further comprising the steps of:

driving the electro-optical device with a current;

sequentially displaying image patterns respectively corresponding to the plurality of blocks into which the pixel region is divided;

measuring the current supplied to the electro-optical elements for each block as a block current; and generating the block correction data based on a difference of the block current with respect to a predetermined reference current value.

9. A method of driving an electro-optical device which comprises a pixel region in which a plurality of electro-optical elements is arranged in a matrix; control data generation means for controlling emission brightness of the electro-optical elements; and memory for storing block correction data to correct control data of each block for each of a plurality of block groups into which the pixel region is divided with different division schemes, the method comprising the steps of:

storing block correction data to correct control data of each block for each of a plurality of block groups in a block correction memory, wherein the plurality of blocks comprising a plurality of block groups each being divided with different division schemes, each of the plurality of electro-optical elements belongs to more than two block groups, and the block correction data comprises a plurality types of data belonging to the plurality of block groups; and specifying a pixel to be controlled by the control data;

performing an operation on the block correction data to generate pixel correction data for the specified pixel;

storing the generated pixel correction data for each pixel in a memory corresponding to each pixel; and correcting the control data by using the generated pixel correction data obtained by the different division schemes.

10. A method of driving an electro-optical device which comprises a pixel region in which a plurality of electro-optical elements is arranged in a matrix; and block correction memory for storing block correction data to correct control data of each block for each of the plurality of block groups into which the pixel region is divided with different division schemes, the method comprising the steps of:

generating and storing in a memory corresponding to each of the electro-optical elements, control data to control emission brightness of each of the electro-optical elements, wherein the control data includes individual control data corresponding to each of the plurality of block groups, the plurality of blocks comprises a plurality of block groups each being divided with different division schemes, each of the plurality of electro-optical elements belonging to more than two block groups, and the block correction data, stored in the block correction memory, comprising a plurality types of data belonging to the plurality of block groups; and correcting the individual control data by using the block correction data of the block group corresponding to the individual control data obtained by the different division schemes.

* * * * *

UNITED STATES PATENT AND TRADEMARK OFFICE

CERTIFICATE OF CORRECTION

PATENT NO. : 7,623,108 B2
APPLICATION NO. : 10/999921
DATED : November 24, 2009
INVENTOR(S) : Jo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1103 days.

Signed and Sealed this

Twenty-sixth Day of October, 2010

David J. Kappos

David J. Kappos
*Director of the United States Patent and Trademark Office*